US005506553A

United States Patent [19]

Makita et al.

[11] Patent Number: 5,506,553

[45] Date of Patent: Apr. 9, 1996

[54] HIGH-FREQUENCY FILTER

[75] Inventors: Takashi Makita; Yutaka Sasaki; Toshimi Kaneko, all of Nagaokakyo, Japan

[73] Assignee: Murata Manufacturing Co., Ltd., Japan

[21] Appl. No.: 324,905

[22] Filed: Oct. 18, 1994

[30] Foreign Application Priority Data

Oct. 22, 1993 [JP] Japan ..... 5-287512
Nov. 9, 1993 [JP] Japan ..... 5-304839

[51] Int. Cl.[6] ..... H01P 1/203

[52] U.S. Cl. ..... 333/204; 333/238

[58] Field of Search ..... 333/204, 205, 333/238, 246

[56] References Cited

U.S. PATENT DOCUMENTS 3,016,497 1/1962 Kostelnick ..... 333/204 X
4,074,214 2/1978 Aichholzer ..... 333/204
4,488,130 12/1984 Young et al. ..... 333/246 X
4,489,292 12/1984 Ogawa ..... 333/246 X
5,313,662 5/1994 Ooi et al. ..... 333/204 X

FOREIGN PATENT DOCUMENTS 63404 3/1993 Japan ..... 333/204

*Primary Examiner*—Paul Gensler
*Attorney, Agent, or Firm*—Ostrolenk, Faber, Gerb & Soffen

[57] ABSTRACT

One example of a high-frequency filter includes a dielectric substrate having a high dielectric constant. On one whole main face of the dielectric substrate, an earth electrode is formed. On the other main face of the dielectric substrate, two pattern electrodes are formed. The pattern electrodes have first parts formed in parallel at an interval, and second parts extended in crossing (non-parallel) directions. Also, on one main face of the dielectric substrate, input-output electrodes are respectively formed near the end parts of the pattern electrodes, and capacitors are respectively formed between the open end parts and the input-output electrodes.

3 Claims, 11 Drawing Sheets

HIGH-FREQUENCY FILTER

BACKGROUND OF THE INVENTION

1. Field of the Invention

The present invention relates to a high-frequency filter, and particularly, to a high-frequency filter which is a plane type distributed constant filter using a dielectric substrate and having plural resonators and is used as, for example, a band-pass filter or the like.

2. Description of the Prior Art

FIG. 18 is a plan view showing an example of a conventional high-frequency filter which is in the background of the present invention, FIG. 19 is a side view thereof. The high-frequency filter 1 includes a dielectric substrate 2 having, for example, a dielectric constant of 10–20. On one whole main face of the dielectric substrate 2, an earth electrode 3 is formed. Also, on the other main face of the dielectric substrate 2, two linear pattern electrodes 4*a* and 4*b* are formed so as to be opposite to the earth electrode 3. In this case, the pattern electrodes 4*a* and 4*b* are formed in parallel at a fixed interval S1 so as to electromagnetically couple. One end of each of the pattern electrodes 4*a* and 4*b* is connected to the earth electrode 3 via one side face of the dielectric substrate 2. One resonator of length λ/4 is constructed with the dielectric substrate 2, the earth electrode 3 and one pattern electrode 4*a*, and another resonator of length λ/4 is constructed with the dielectric substrate 2, the earth electrode 3 and the other pattern electrode 4*b*. Also, input-output electrodes 5*a* and 5*b* are formed so as to extend from intermediate parts of the pattern electrodes 4*a* and 4*b* to both side parts of the dielectric substrate 2. Thus, the high-frequency filter 1 is constructed as a comb line filter.

FIG. 20 is a plan view showing another example of a conventional high-frequency filter which is in the background of the present invention. In the conventional example shown in FIG. 20, compared with the conventional example shown in FIG. 18 and FIG. 19, the opposite ends of the pattern electrodes 4*a* and 4*b* are connected to the earth electrode 3. Thus, the high-frequency filter 1 shown in FIG. 20 is constructed as an interdigital filter.

Also, for example, Japanese publication No. 28441/1985 discloses an example of a conventional strip line filter which is in the background of the present invention. FIG. 21 is a plan view showing an example of such a conventional high-frequency filter, FIG. 22 is a side view thereof. The high-frequency filter 1 shown in FIG. 21 and FIG. 22 includes a dielectric substrate 2 having, for example, a dielectric constant of 10–20. On one whole main face of the dielectric substrate 2, an earth electrode 3 is formed. Also, on the other main face of the dielectric substrate 2, five linear pattern electrodes 4*a*, 4*b*, 4*c*, 4*d* and 4*e* are formed so as to be opposite to the earth electrode 3. In this case, the pattern electrodes 4*a*–4*e* are formed in parallel at a fixed interval S1 so as to electromagnetically couple each two adjoining pattern electrodes. One end of each of the pattern electrodes 4*a*–4*e* is connected to the earth electrode 3 via one side face of the dielectric substrate 2. Thus, five resonators of length λ/4 are constructed with the dielectric substrate 2, the earth electrode 3 and the five pattern electrodes 4*a*–4*e*. Also, input-output electrodes 5*a* and 5*b* are formed so as to extend from intermediate parts of the pattern electrodes 4*a* and 4*e* to both sides of the dielectric substrate 2. Thus, the high-frequency filter 1 is constructed as a comb line filter.

In the high-frequency filter 1 shown in FIG. 18 through FIG. 20, for miniaturizing the filter as required in recent years, when the dielectric constant of the dielectric substrate 2 is increased for shortening each length L1 of the pattern electrodes 4*a* and 4*b* of the two resonators and so on, an interference effect in an electromagnetic field between the two resonators is too strong. That is, when the dielectric constant of the dielectric substrate 2 is increased, the electromagnetic coupling between the pattern electrodes 4*a* and 4*b* of the two resonators is too strong. Thus, frequency characteristics such a selectivity characteristic of the high-frequency filter are deteriorated. For correcting the deterioration of the frequency characteristics, it is necessary to redesign it for extending the interval S1 between the pattern electrodes 4*a* and 4*b* of the two resonators and so on. However, when the interval S1 between the pattern electrodes 4*a* and 4*b* of the two resonators is extended, the high-frequency filter becomes large, not miniaturized.

Also, in the high-frequency filter 1 shown in FIG. 18 through FIG. 20, since its input-output impedance and an external circuit are matched by drawing the input-output electrodes 5*a* and 5*b* from the intermediate parts of the pattern electrodes 4*a* and 4*b* directly, the coupling degree between the two resonators is changed by an interference effect in an electromagnetic field, so it is necessary to adjust each distance D1 from the short ends (the ends connected to the earth electrode 3) of the pattern electrodes 4*a* and 4*b* to the input-output electrodes 5*a* and 5*b*, or each width T of the input-output electrodes 5*a* and 5*b*, which makes such a filter complex and difficult to design.

Furthermore, in the high-frequency filter 1 shown in FIG. 18 through FIG. 20, there is a problem that even if the input-output impedance is matched as above mentioned, when the impedance of the external circuit is changed, the frequency characteristic is easily changed too.

Also, in the high-frequency filter 1 shown in FIG. 21 and FIG. 22, for obtaining a high efficiency frequency characteristic having a large attenuation, it is a problem that not only must the resonators be coupled to form a multi-stage filter, which makes the filter large, but also it becomes difficult, involving an exponential function, to design in order to increase the stage number of the resonators.

Furthermore, in the high-frequency filter 1 shown in FIG. 21 and FIG. 22, for miniaturizing the filter as the market has required in recent years, when the dielectric constant of the dielectric substrate 2 is increased for shortening each length L1 of the pattern electrodes 4*a*–4*e* of the five resonators and so on, an interference effect in an electromagnetic filed between each two adjoining resonators is too strong. Thus, frequency characteristics such as a selectivity characteristic of the high-frequency filter are deteriorated. For correcting the deterioration of the frequency characteristics, a redesign is necessary for extending the interval S1 between the pattern electrodes of each two adjoining resonators and so on. Then, when the interval S1 between the pattern electrodes of two adjoining resonators is extended, the high-frequency filter becomes large, which interferes with miniaturizing, and it becomes difficult to design it. In some cases, it is impossible to design it.

SUMMARY OF THE INVENTION

Therefore, it is a primary object of the present invention to provide a high-frequency filter that can be miniaturized.

A high-frequency filter according to the present invention is a high-frequency filter comprising a dielectric substrate having a high dielectric constant, an earth electrode formed on one main face of the dielectric substrate, and plural pattern electrodes formed on the other main face of the dielectric substrate so as to be opposite to the earth electrode, wherein first parts of the plural pattern electrodes are formed in parallel separated by an interval, and second parts of the plural pattern electrodes are formed so as to extend in crossing (non-parallel) directions.

In the high-frequency filter according to the present invention, plural resonators are formed by the dielectric substrate, the earth electrode and the plural pattern electrodes.

Also, since the first parts of the plural pattern electrodes are formed in parallel at an interval, the plural pattern electrodes are electromagnetically coupled at the first parts. However, since the second parts of the plural pattern electrodes are formed so as to extend in crossing directions, the plural pattern electrodes are hardly electromagnetically coupled at the second parts. Thus, the plural resonators hardly have any electromagnetic interference effect.

According to the present invention, in a high-frequency filter, since a dielectric substrate having a high dielectric constant is used, the length of each of the plural pattern electrodes can be shortened, and furthermore, since the plural resonators have hardly any interference effect in an electromagnetic field, the interval between the pattern electrodes of the plural resonators can be narrowed. Thus, it is possible to miniaturize the high-frequency filter.

It is another object of the present invention to provide a high-frequency filter which can be miniaturized and has a good frequency characteristic.

Another high-frequency filter according to the present invention is a high-frequency filter comprising a dielectric substrate, an earth electrode formed on one main face of the dielectric substrate, and plural pattern electrodes formed on the other main face of the dielectric substrate so as to be opposite to the earth electrode, wherein first parts of the plural pattern electrodes are formed in parallel at an interval, second parts of the plural pattern electrodes are formed so as to extend in crossing directions, and a dielectric layer is formed between overlapped parts of the second parts of the plural pattern electrodes. Further, an electrostatic capacitance may be formed between two input-output electrodes.

In this high-frequency filter, plural resonators are formed by the dielectric substrate, the earth electrode and the plural pattern electrodes.

Since the dielectric layer is formed between the overlapped parts of the second parts of the plural pattern electrodes, and an electrostatic capacitance is generated therebetween, not only an electromagnetic coupling, but also a capacitive coupling is generated between the plural pattern electrodes. Thus, the interval between the plural pattern electrodes can be extended for decreasing the coupling. Accordingly, in addition to the effect of overlapping the second parts of the plural pattern electrodes, the distance in the line direction of the plural pattern electrodes can be shortened.

According to the present invention, in a high-frequency filter, the distance in the line direction of the plural pattern electrodes can be shortened. Thus, it is possible to miniaturize a high-frequency filter. Further, when a dielectric substrate having a high dielectric constant is used, the length of each of the plural pattern electrodes can be shortened and more miniaturized, whereby the effects of the present invention become even more preferable.

Furthermore, according to the present invention, in a high-frequency filter, since the dielectric layer is formed between the overlapped parts of the second parts of the plural pattern electrodes, and the electrostatic capacitance is generated therebetween, an attenuation pole is generated at a low frequency side of a passband, improving the frequency characteristic. Further, when electrostatic capacitance is formed between two input-output electrodes in the high-frequency filter, attenuation poles are generated at both a high frequency side and a low frequency side of a passband, whereby the frequency characteristic becomes even better.

The above and further objects, features and advantages of the present invention will be more fully apparent from the following detailed description of the embodiments with accompanying drawings.

DESCRIPTION OF THE PREFERRED EMBODIMENTS

Figure 1:
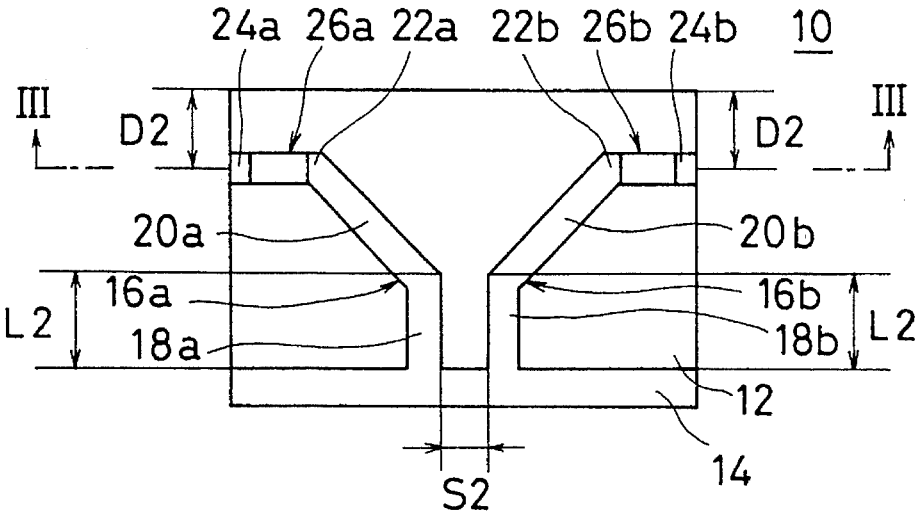
FIG. 1 is a plan view showing one embodiment of the present invention.
Figure 2:
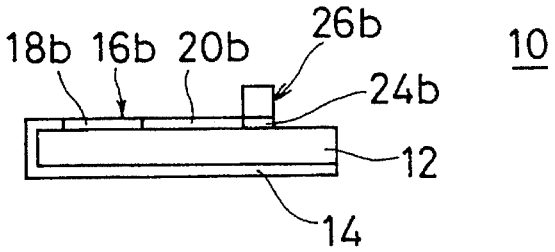
FIG. 2 is a side view of the embodiment shown in FIG. 1.
Figure 3:
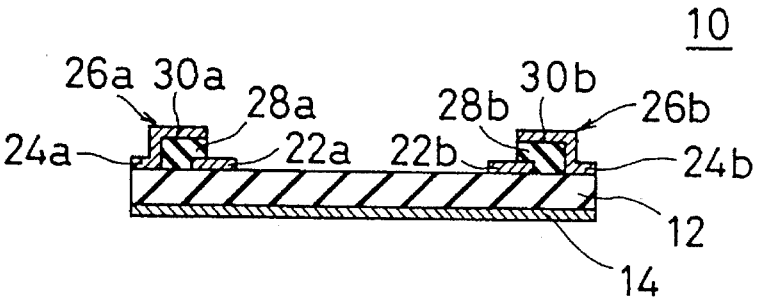
FIG. 3 is a sectional view taken along the line III—III of FIG. 1.

FIG. 1 is a plan view showing one embodiment of the present invention, FIG. 2 is a side view thereof, and FIG. 3 is a sectional view taken along the line III—III of FIG. 1. The high-frequency filter 10 includes, for example, a rectangular dielectric substrate 12. A material having a high dielectric constant, for example, a dielectric constant of 50, is used as the dielectric substrate 12.

On one whole main face of the dielectric substrate 12, an earth electrode 14 is formed. The earth electrode 14 is also extended onto an end part of the other main face of the dielectric substrate 12.

On a second main face of the dielectric substrate 12, two pattern electrodes 16*a* and 16*b* are formed. One pattern electrode 16*a* has a first part 18*a* linearly extending from the earth electrode 14 in the front and rear direction of the substrate, and a second part 20*a* linearly extending from the first part 18*a* in a direction toward the outside of the substrate at an angle, for example, 45 degrees. Similarly, the other pattern electrode 16*b* has a first part 18*b* linearly extending from the earth electrode 14 in the front and rear direction, and a second part 20*b* linearly extending from the first part 18*b* in an outward direction at an angle, for example, 45 degrees. Thus, in the two pattern electrodes 16*a* and 16*b*, the first parts 18*a* and 18*b* are formed in parallel at an interval S2, and the second parts 20*a* and 20*b* are formed so as to extend in crossing (non-parallel) directions. Thus, the two pattern electrodes 16*a* and 16*b* are electromagnetically coupled at the first parts 18*a* and 18*b*, and are hardly electromagnetically coupled at the second parts 20*a* and 20*b*.

Furthermore, on the second main face of the dielectric substrate 12, two input-output electrodes 24*a* and 24*b* are formed near the tip parts (the open ends) 22*a* and 22*b* of the pattern electrodes 16*a* and 16*b*.

Also, capacitors 26*a* and 26*b* are respectively formed between the tip parts 22*a*, 22*b* of the pattern electrodes 16*a*, 16*b* and the input-output electrodes 24*a* and 24*b*. As shown in FIG. 3, one capacitor 26*a* is formed by the tip part 22*a* of the pattern electrode 16*a*, a dielectric layer 28*a* formed on the tip part 22*a* and so on, and an electrode 30*a* extending from the input-output electrode 24*a* to the top of the dielectric layer 28*a*. Similarly, the other capacitor 26*b* is formed by the tip part 22*b* of the pattern electrode 16*b*, a dielectric layer 28*b* formed on the tip part 22*b* and so on, and an electrode 30*b* extending from the input-output electrode 24*b* to the top of the dielectric layer 28*b*.

Figure 4:
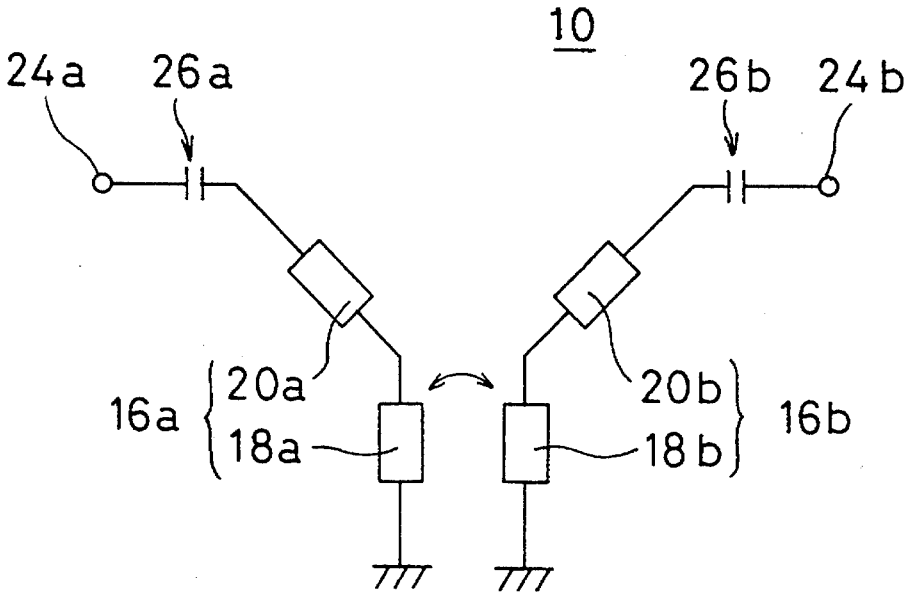
FIG. 4 is an equivalent circuit diagram of the embodiment shown in FIG. 1.

Accordingly, the high-frequency filter 10 has an equivalent circuit shown in FIG. 4.

In the high-frequency filter 10, one resonator of length λ/4 is constructed with the dielectric substrate 12, the earth electrode 14 and one pattern electrode 16*a*, another resonator of length λ/4 is constructed with the dielectric substrate 12, the earth electrode 14 and the other pattern electrode 16*b*.

Also, in the high-frequency filter 10, since the first parts 18*a* and 18*b* of the two pattern electrodes 16*a* and 16*b* are formed in parallel at the interval $2, the two pattern electrodes 16*a* and 16*b* are electromagnetically coupled at the first parts 18*a* and 18*b*. However, since the second parts 20*a* and 20*b* of the two pattern electrodes 16*a* and 16*b* are formed so as to extend in crossing directions, the two pattern electrodes 16*a* and 16*b* are hardly electromagnetically coupled at the second parts 20*a* and 20*b*. Thus, the two resonators hardly have any interference effect in an electromagnetic field.

In the high-frequency filter 10, since the dielectric substrate 12 has a high dielectric constant, the length of each of the two pattern electrodes 16*a* and 16*b* can be shortened in comparison to each length in the conventional example, and furthermore, since the two resonators hardly have any interference effect in an electromagnetic field, the interval $2 between the pattern electrodes 16*a* and 16*b* of the two resonators can be narrowed in comparison to the interval S1 in the conventional example. Thus, in the high-frequency filter 10, it is possible to make the filter smaller than the conventional example.

Also, in the high-frequency filter 10, since the two resonators are coupled mainly by electromagnetic coupling at only the first parts 18*a* and 18*b* near the 10 short proximal ends of the pattern electrodes 16*a* and 16*b* of the two resonators, and the two resonators hardly have any interference effect in an electromagnetic field, regardless of using the dielectric substrate 12 having a high dielectric constant, complexity or difficulty in design is rare, so it is comparatively easy to design.

Furthermore, in the high-frequency filter 10, since the input-output electrodes 24*a* and 24*b* are connected to the pattern electrodes 16*a* and 16*b* of the two resonators via the capacitors 26*a* and 26*b*, it is possible to have a comparatively high input-output impedance, for example, one hundred and several tens of ohms. Thus, in the high-frequency filter 10, against the impedance changing of the external circuit having a nominal impedance of 50 ohms, the deterioration of the frequency characteristic is small.

Also, the high-frequency filter 10 has some degree of freedom in design, as the distance L2 from the end of the earth electrode 14 on the second main face of the dielectric substrate 12 to the 45 degree corner of the pattern electrodes 16*a* and 16*b*, or the interval $2 between the first parts 18*a* and 18*b* of the pattern electrodes 16*a* and 16*b*, can be suitably changed. Further, the position spacing D2 of the input-output electrodes 24*a* and 24*b* can be changed to some extent without substantially changing the λ/4 length of the resonator. That is, handling becomes easy in case of mounting the high-frequency filter on a printed circuit board or the like.

Figure 5:
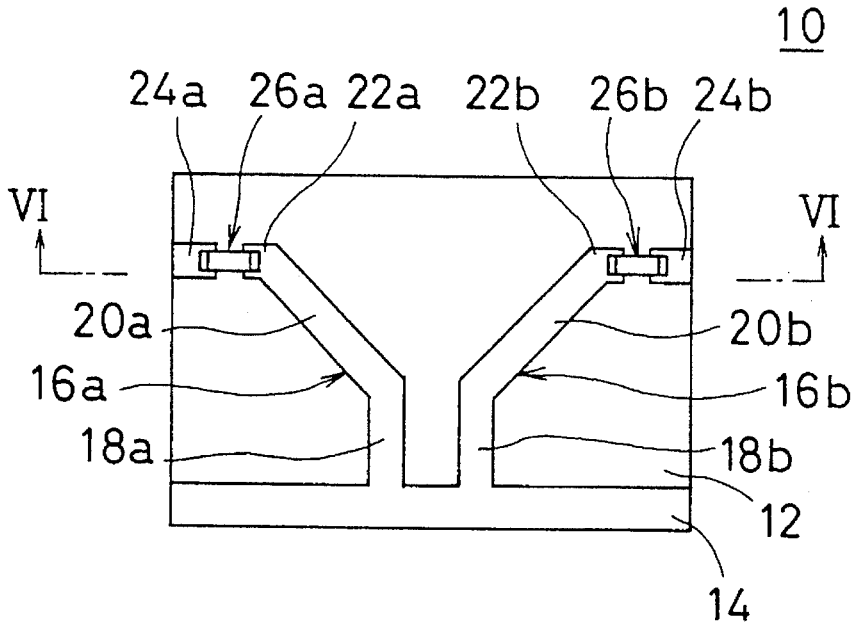
FIG. 5 is a plan view showing a modification of the embodiment shown in FIG. 1.
Figure 6:
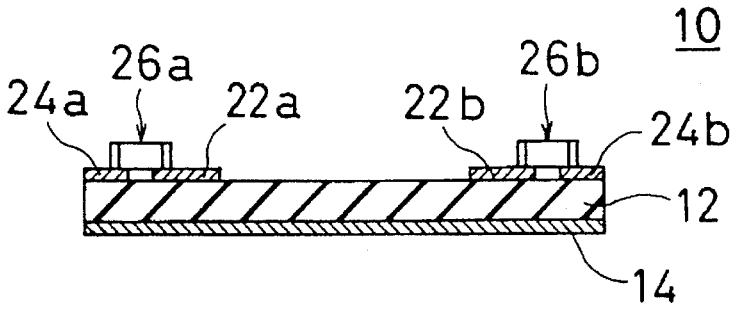
FIG. 6 is a sectional view taken along the line VI—VI of FIG. 5.

FIG. 5 is a plan view showing a modification of the embodiment shown in FIG. 1, FIG. 6 is a sectional view taken along the line VI—VI of FIG. 5. The main difference between the embodiment shown in FIG. 5 and FIG. 6, and the embodiment shown in FIG. 1, is that chip capacitors 26*a* and 26*b* are connected between the tip parts 22*a*, 22*b* of the pattern electrodes 16*a*, 16*b* and the input-output electrodes 24*a* and 24*b*.

Figure 7:
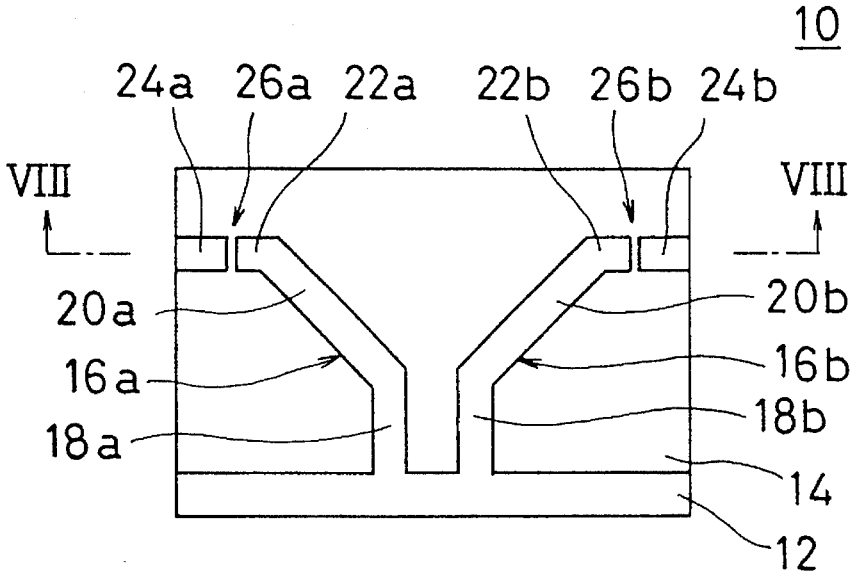
FIG. 7 is a plan view showing another modification of the embodiment shown in FIG. 1.
Figure 8:
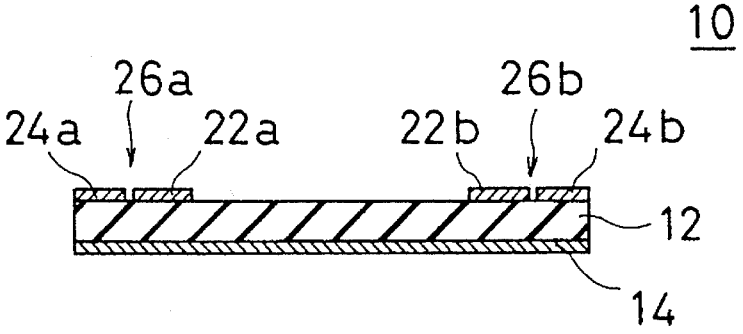
FIG. 8 is a sectional view taken along the line VIII—VIII of FIG. 7.

FIG. 7 is a plan view showing another modification of the embodiment shown in FIG. 1, FIG. 8 is a sectional view taken along the line VIII—VIII of FIG. 7. The main difference between the embodiment shown in FIG. 7 and FIG. 8, and the embodiment shown in FIG. 1, is that the tip parts 22*a* and 22*b* of the pattern electrodes 16*a* and 16*b* and the input-output electrodes 24*a* and 24*b* are formed close together. Thus, the capacitances of the capacitors 26*a* and 26*b* formed by the gap between the tip parts 22*a*, 22*b* of the pattern electrodes 16*a*, 16*b* and the input-output electrodes 24*a*, 24*b*, are respectively used.

Meanwhile, in each embodiment shown in FIG. 1 through FIG. 8, though the second parts 20*a* and 20*b* of the pattern electrodes 16*a* and 16*b* are respectively formed extending from the first parts 18*a* and 18*b* at an angle of 45 degrees, it is sufficient merely to form the second parts 20*a* and 20*b* extending in crossing directions, so the second parts 20*a* and 20*b* may be formed at another angle. For example, one angle may be 40 degrees and the other angle may be 50 degrees.

Also, in each embodiment shown in FIG. 1 through FIG. 8, though having two pattern electrodes, that is, two resonators of length λ/4, the present invention can also be applied to a high-frequency filter having three pattern electrodes, that is, three resonators of length λ/4 in this case, the pattern electrodes may be formed so that the second parts (the open ends) are extended in crossing directions in each two adjoining pattern electrodes.

Meanwhile, in each embodiment shown in FIG. 1 through FIG. 8, though in each example, each resonator has a length of λ/4 having the first end connected to the earth electrode, the present invention is also applicable to a high-frequency filter using resonators of length λ/2 having the first end open.

Furthermore, in each embodiment shown in FIG. 1 through FIG. 8, though one dielectric substrate is used, the present invention is also applicable to a multilayer high-frequency filter wherein plural dielectric layers and so on are laminated and made uniform. In this case, since the coupling between the pattern electrodes becomes strong, the present invention becomes especially useful.

Figure 9:
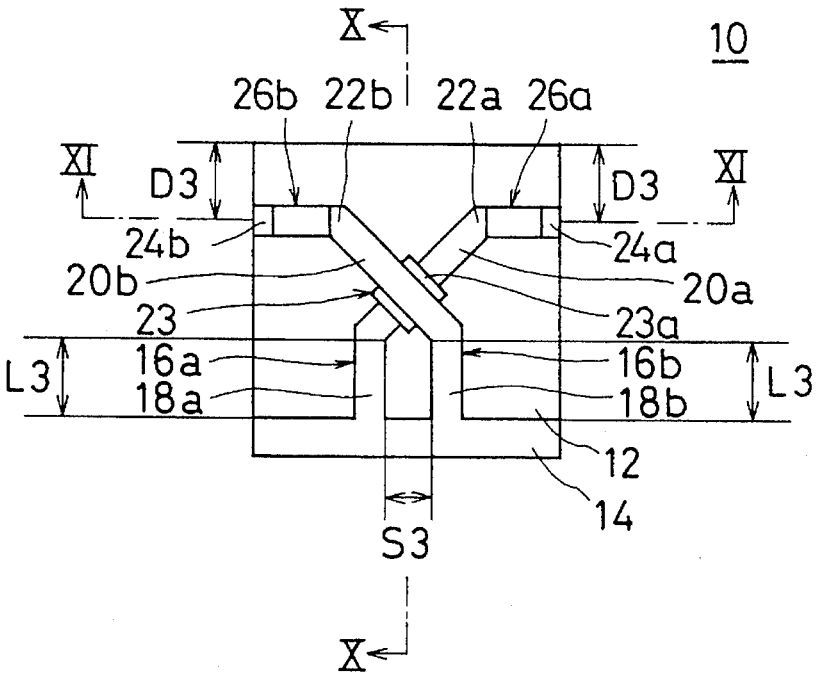
FIG. 9 is a plan view showing another embodiment of the present invention.
Figure 10:
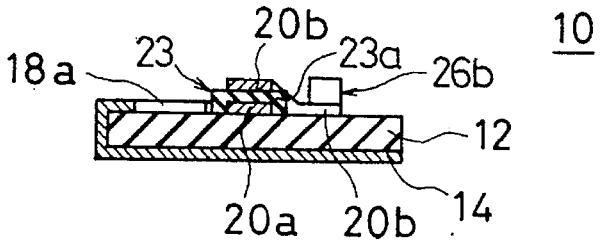
FIG. 10 is a sectional view taken along the line X—X of FIG. 9.
Figure 11:
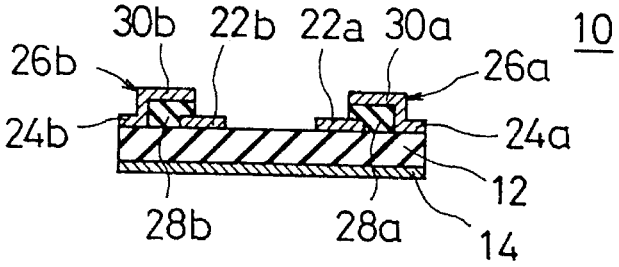
FIG. 11 is sectional view taken along the line XI—XI of FIG. 9.

FIG. 9 is a plan view showing another embodiment of the present invention, FIG. 10 is a sectional view taken along the line X—X of FIG. 9. FIG. 11 is a sectional view taken along the line XI—XI of FIG. 9. The high-frequency filter 10 shown in FIG. 9 includes, for example, a rectangular dielectric substrate 12. A material having a high dielectric constant, for example, a dielectric constant of 50 or more, is used as the dielectric substrate 12.

On one whole main face of the dielectric substrate 12, an earth electrode 14 is formed. The earth electrode 14 is also extended across one side face and onto an end part of the second main face of the dielectric substrate 12.

On the second main face of the dielectric substrate 12, two pattern electrodes **16*a* and 16*b* are formed. One pattern electrode 16*a* has a first part 18*a* linearly extending from the earth electrode 14 in the front and rear direction, and a second part 20*a* linearly extending from the first part 18*a* in an inward direction 10 at an angle, for example, 48 degrees. Similarly, the other pattern electrode 16*b* has a first part 18*b* linearly extending from the earth electrode 14 in the front and rear direction, and a second part 20*b* linearly extending from the first part 18*b* in an inward direction at an angle, for example, 45 degrees. In this case, in the two pattern electrodes 16*a* and 16*b*, the first parts 18*a* and 18*b* are formed in parallel at an interval $3, and the second parts 20*a* and 20*b* are formed so as to cross each other. Thus, the two pattern electrodes 16*a* and 16*b* are electromagnetically coupled at the first parts 18*a* and 18*b*, and are hardly electromagnetically coupled at the second parts 20*a* and 20*b*. Meanwhile, the tip parts (the open end parts) 22*a* and 22*b* of the pattern electrodes 16*a* and 16*b* are formed so as to be at opposite sides of the dielectric substrate 12**.

Also, a capacitor 23 is formed between overlapped parts of the second parts **20*a* and 20*b* of the pattern electrodes 16*a* and 16*b*. As shown in FIG. 10, the capacitor 23 is formed by an intermediate part of the second part 20*a* of the pattern electrode 16*a*, a dielectric layer 23*a* formed on the intermediate part and so on, and an intermediate part of the second part 20*b* of the pattern electrode 16*b* formed on the dielectric layer 23*a*. Meanwhile, the dielectric layer 23*a* is formed, for example, of a dielectric material such as polyimide, for example 5 μm thick, by a method such as photolithography. Then, between the intermediate parts of the other side parts 20*a* and 20*b***, an electrostatic capacitance Cc, for example, 0.2–0.8 pF, is generated.

Furthermore, on the second main face of the dielectric substrate 12, two input-output electrodes **24*a* and 24*b* are formed near the tip parts 22*a* and 22*b* of the pattern electrodes 16*a* and 16*b***.

Also, capacitors **26*a* and 26*b* are respectively formed between the tip parts 22*a*, 22*b* of the pattern electrodes 16*a*, 16*b* and the input-output electrodes 24*a* and 24*b*. As shown in FIG. 11, one capacitor 26*a* is constructed with the tip part 22*a* of the pattern electrode 16*a*, a dielectric layer 28*a* formed on the tip part 22*a* and so on, and an electrode 30*a* extending from the input-output electrode 24*a* to the top of the dielectric layer 28*a*. Similarly, the other capacitor 26*b* is constructed with the tip part 22*b* of the pattern electrode 16*b*, a dielectric layer 28*b* formed on the tip part 22*b* and so on, and an electrode 30*b* extending from the input-output electrode 24*b* to the top of the dielectric layer 28*b***.

Figure 12:
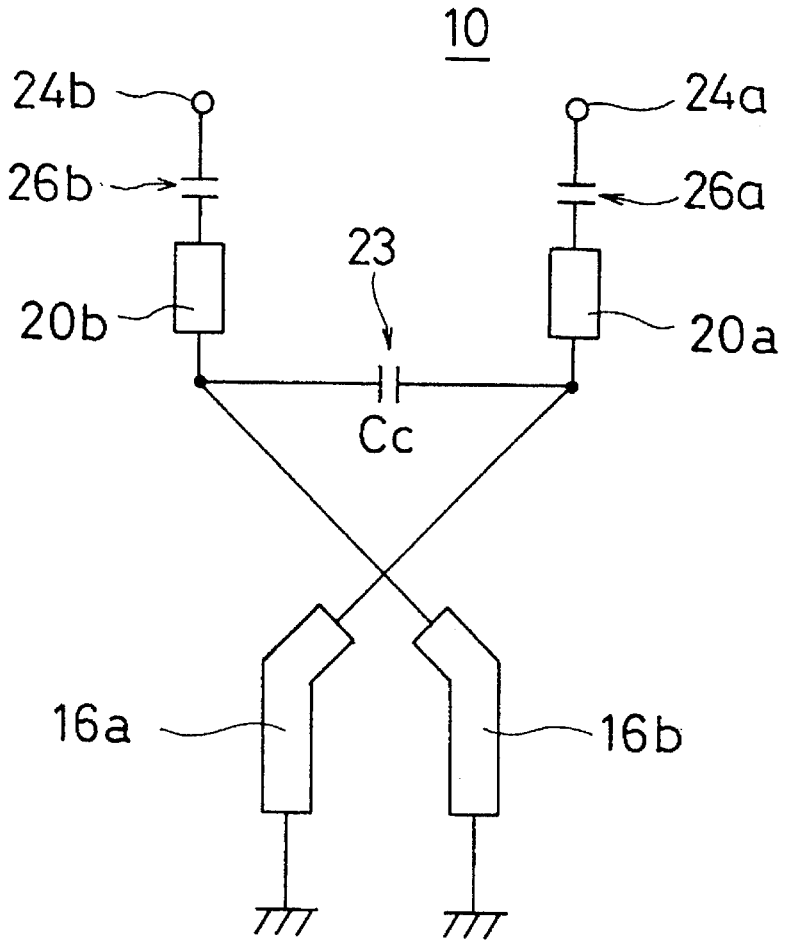
FIG. 12 is an equivalent circuit diagram of the embodiment shown in FIG. 9.

Accordingly, the high-frequency filter 10 shown in FIG. 9 has an equivalent circuit shown in FIG. 12.

In the high-frequency filter 10 shown in FIG. 9, one resonator of length λ/4 is constructed with the dielectric substrate 12, the earth electrode 14 and one pattern electrode **16*a*, another resonator of length λ/4 is constructed with the dielectric substrate 12, the earth electrode 14 and the other pattern electrode 16*b***.

Also, in the high-frequency filter 10 shown in FIG. 9, since the first parts **18*a* and 18*b* of the two pattern electrodes 16*a* and 16*b* are formed in parallel at the interval $3, the two pattern electrodes 16*a* and 16*b* are electromagnetically coupled at the first parts 18*a* and 18*b*. However, since the second parts 20*a* and 20*b* of the two pattern electrodes 16*a* and 16*b* are formed so as to cross each other, the two pattern electrodes 16*a* and 16*b* are hardly electromagnetically coupled at the second parts 20*a* and 20*b***. Thus, the two resonators hardly have any interference effect in an electromagnetic field.

Furthermore, in the high-frequency filter 10 shown in FIG. 9, since the dielectric layer **23*a* is formed between the overlapped parts of the second part 20*a* and 20*b* of the two pattern electrodes 16*a* and 16*b*, and the electrostatic capacitance Cc is generated therebetween, besides an electromagnetic coupling, a capacitive coupling is generated between the two pattern electrodes 16*a* and 16*b*. Thus, the electromagnetic coupling must be decreased by extending the interval between the two pattern electrodes 16*a* and 16*b*. Accordingly, besides the effect of overlapping the second parts 20*a* and 20*b* of the two pattern electrodes 16*a* and 16*b*, the distance in the line direction of the two pattern electrodes 16*a* and 16*b* can be drastically shortened by extending the interval between the two pattern electrodes 16*a* and 16*b*, compared with the conventional examples shown in FIG. 18 through FIG. 22 and the embodiments shown in FIG. 1 through FIG. 8**.

As mentioned above, in the high-frequency filter 10 shown in FIG. 9, since the dielectric substrate 12 having a high dielectric constant is used, the length of each of the two pattern electrodes **16*a* and 16*b* can be shortened in comparison with each length in the conventional examples shown in FIG. 18 through FIG. 22. Furthermore, the distance in the line direction of the two pattern electrodes 16*a* and 16*b* can be drastically narrowed, in comparison with the distance in the conventional examples shown in FIG. 18 through FIG. 22 and the embodiments shown in FIG. 1 through FIG. 8. Thus, in the high-frequency filter 10 shown in FIG. 9**, it is possible to miniaturize more than in the conventional example and so on.

Furthermore, in the high-frequency filter 10 shown in FIG. 9, since the dielectric layer **23*a* is formed between the crossing parts of the second parts 20*a* and 20*b* of the two pattern electrodes 16*a* and 16*b***, and the electrostatic capacitance Cc is generated therebetween, an attenuation pole is generated in a low frequency side, whereby the frequency characteristic becomes better.

Also, in the high-frequency filter 10 shown in FIG. 9, since the two resonators are coupled mainly by electromagnetic coupling at only the first parts 18*a* and 18*b* near the short ends of the pattern electrodes 16*a* and 16*b* of the two resonators, and the two resonators hardly have any interference effect in an electromagnetic field, regardless of the dielectric substrate 12 having a high dielectric constant, complexity or difficulty in design is rare, whereby it is comparatively easy to design.

Furthermore, in the high-frequency filter 10 shown in FIG. 9, since the input-output electrodes 24*a* and 24*b* are connected to the pattern electrodes 16*a* and 16*b* of the two resonators via the capacitors 26*a* and 26*b*, it is possible to have a comparatively high input-output impedance, for example, one hundred and several tens of ohms. Thus, in the high-frequency filter 10 shown in FIG. 9, against the impedance changing of the external circuit having a nominal impedance of 50 ohms, the deterioration of the frequency characteristic is small.

Also, in the high-frequency filter 10 shown in FIG. 9, there is some degree of freedom in design, as the distance L3 from the end of the earth electrode 14 on the second main face of the dielectric substrate 12 to the 45 degree corner parts of the pattern electrodes 16*a* and 16*b* or the interval $3 between the first parts 18*a* and 18*b* of the pattern electrodes 16*a* and 16*b* can be suitably changed, and the position spacing D3 of the input-output electrodes 24*a* and 24*b* can be changed to some extent in a state wherein the λ/4 length of the resonator is hardly changed.

Figure 13:
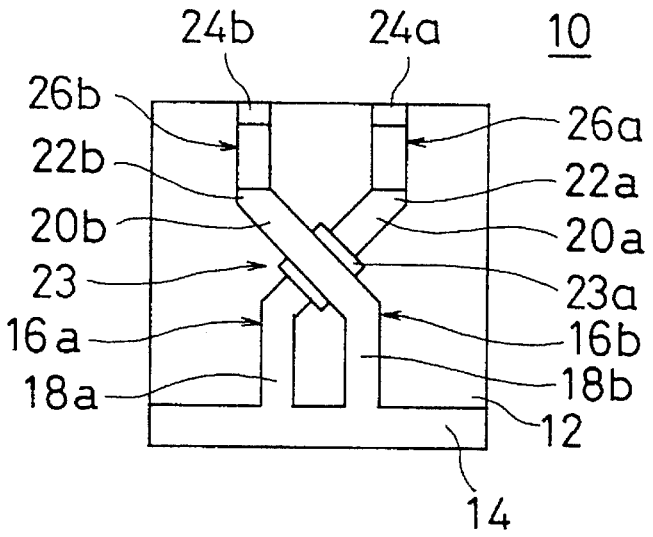
FIG. 13 is a plan view showing still another embodiment of the present invention.
Figure 14:
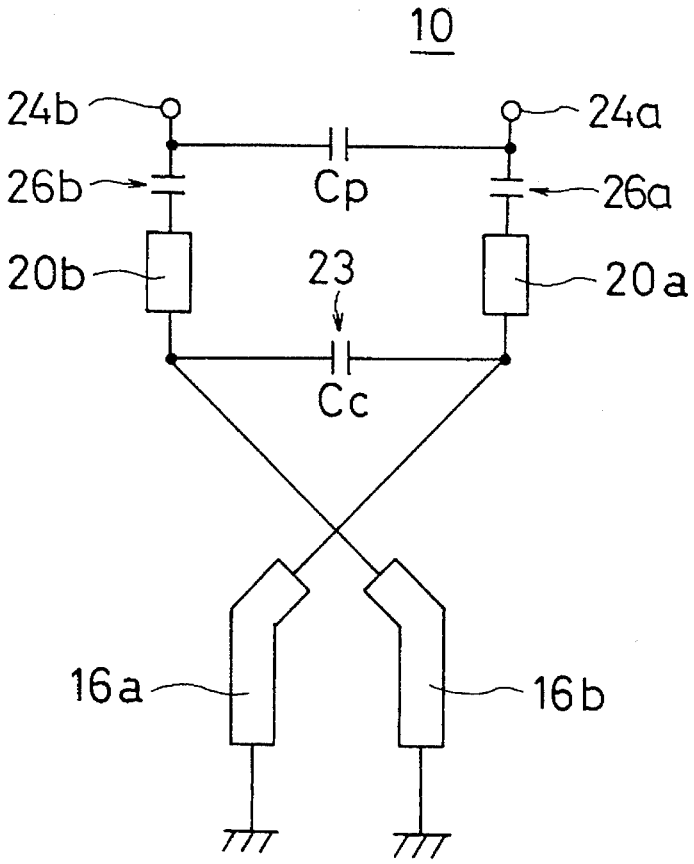
FIG. 14 is an equivalent circuit diagram of the embodiment shown in FIG. 13.

FIG. 13 is a plan view showing still another embodiment of the present invention. In the embodiment shown in FIG. 13, compared with the embodiment shown in FIG. 9, the tip parts 22*a* and 22*b* of the two pattern electrodes 16*a* and 16*b* are formed at the opposite side of the dielectric substrate 12 from the earth electrode 14. Furthermore, the two input-output electrodes 24*a* and 24*b* are formed close to each other. Thus, electrostatic capacitance Cp is generated between the two input-output electrodes 24*a* and 24*b*. Accordingly, the high-frequency filter 10 shown in FIG. 13 has an equivalent circuit shown in FIG. 14.

In the high-frequency filter 10 shown in FIG. 13, compared with the high-frequency filter 10 shown in FIG. 9, since the electrostatic capacitance Cp is generated between the two input-output electrodes 24*a* and 24*b*, an attenuation pole is generated at both a low frequency side and a high frequency side, whereby the frequency characteristic becomes better.

Also, in the high-frequency filter 10 shown in FIG. 13, compared with the high-frequency filter 10 shown in FIG. 9, since the distance between the tip parts 22*a*, 22*b* of the two pattern electrodes 16*a*, 16*b*, the distance between the two input-output electrodes 24*a* and 24*b* and so on become narrow, it is possible to miniaturize even more.

Figure 15:
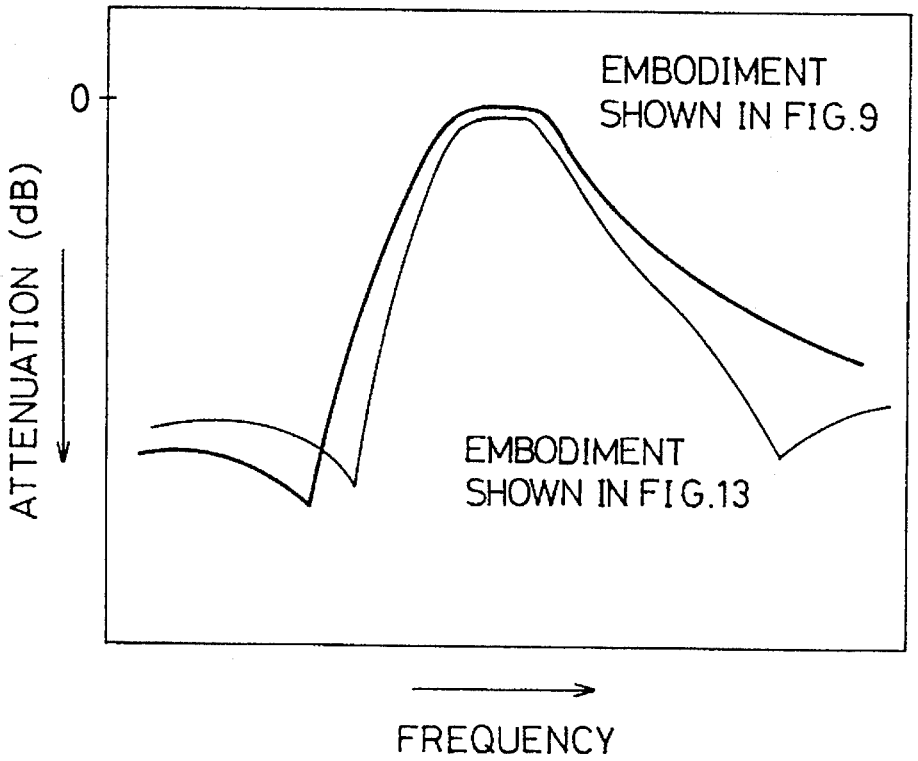
FIG. 15 is a graph showing frequency characteristics of the embodiment shown in FIG. 9 and the embodiment shown in FIG. 13.

FIG. 15 shows the frequency characteristics of the embodiment shown in FIG. 9 and the embodiment shown in FIG. 13. From the frequency characteristics shown in FIG. 15, in the embodiment shown in FIG. 13, compared with the embodiment shown in FIG. 9, attenuation poles are generated at both a high frequency side and a low frequency side, so the frequency characteristic is better.

Figure 16:
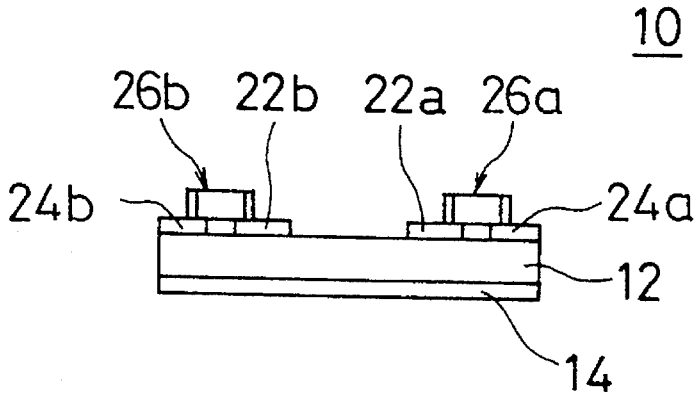
FIG. 16 is an illustrative view showing a modification of the embodiment shown in FIG. 9.
Figure 17:
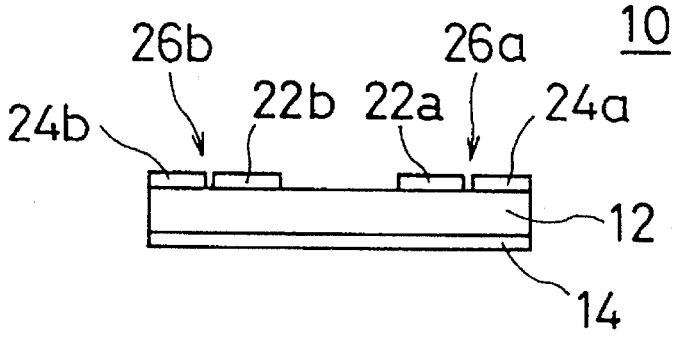
FIG. 17 is an illustrative view showing another modification of the embodiment shown in FIG. 9.
Figure 18:
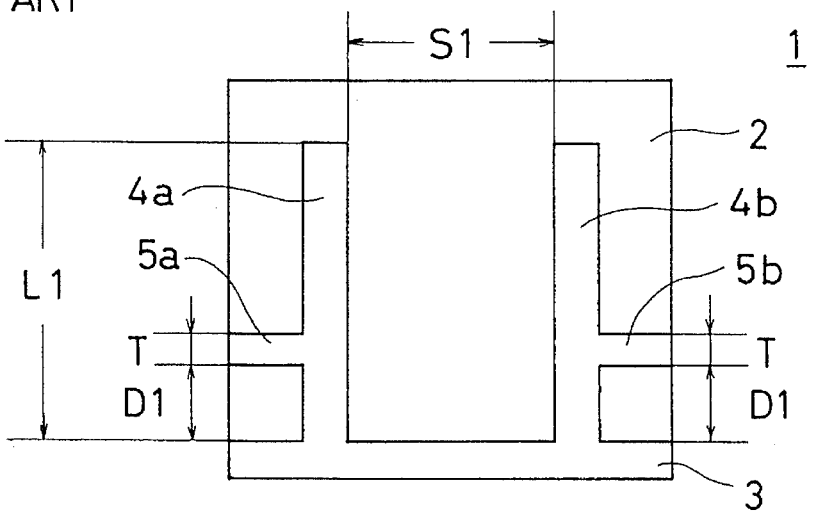
FIG.18 PRIOR ART
FIG. 18 is a plan view showing an example of a conventional high-frequency filter which is a background of the present invention.
Figure 19:
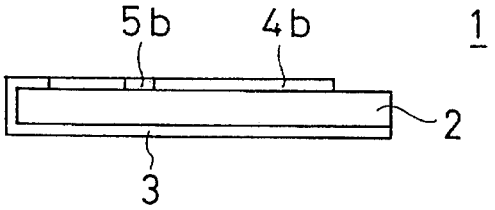
FIG.19 PRIOR ART
FIG. 19 is a side view of the high-frequency filter shown in FIG. 18.
Figure 20:
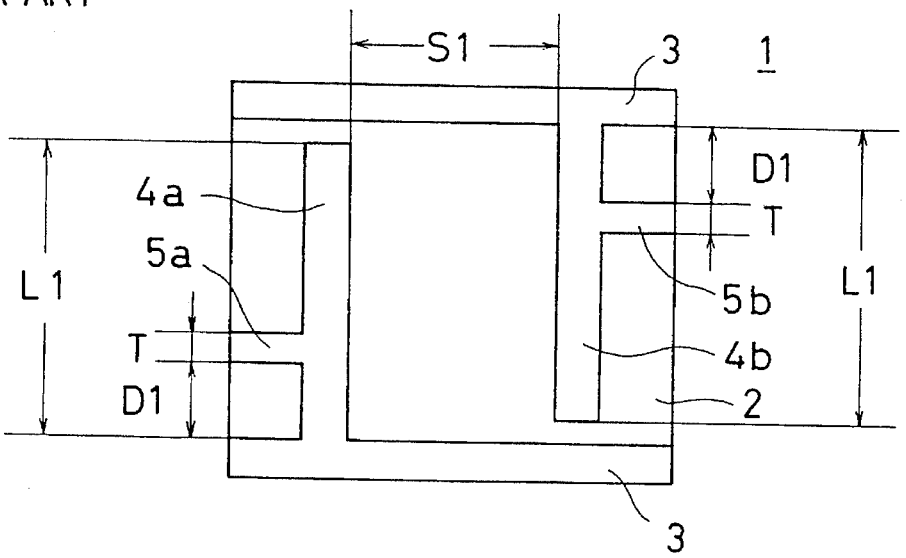
FIG.20 PRIOR ART
FIG. 20 is a plan view showing another example of a conventional high-frequency filter which is a background of the present invention.
Figure 21:
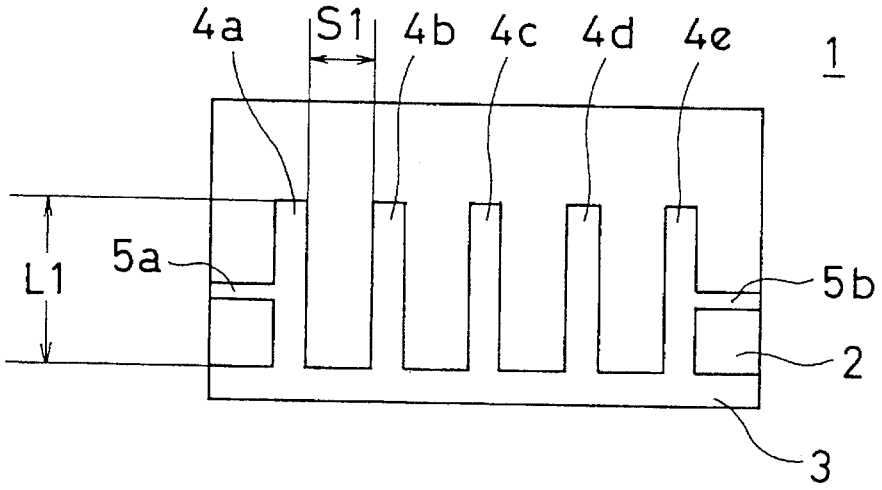
FIG. 21 PRIOR ART
FIG. 21 is a plan view showing still another example of a conventional high-frequency filter.
Figure 22:
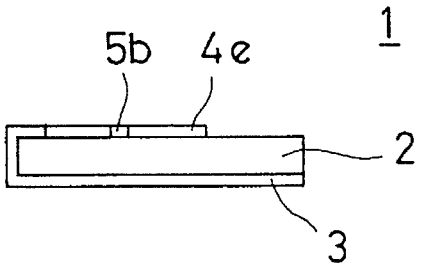
FIG. 22 PRIOR ART
FIG. 22 is a side view of the high-frequency filter shown in FIG. 21.

Meanwhile, in each embodiment shown in FIG. 9 through FIG. 14, though the dielectric .layers 28*a*, 28*b* and so on are used as the capacitors 26*a* and 26*b* connected between the two pattern electrodes 16*a*, 16*b* and the two input-output electrodes 24*a* and 24*b*, a chip capacitor, a capacitor formed by a gap capacitance or the like, may also be used as the capacitor. For example, compared with the embodiment shown in FIG. 9, as shown in FIG. 16, as the capacitors 26*a* and 26*b* connected between the tip parts 22*a*, 22*b* of the pattern electrodes 16*a*, 16*b* and the input-output electrodes 24*a*, 24*b*, chip capacitors are respectively used. Or, compared with the embodiment shown in FIG. 9, as shown in FIG. 17, the tip parts 22*a*, 22*b* of the pattern electrodes 16*a*, 16*b* and the input-output electrodes 24*a*, 24*b* may be closely formed, so that a gap capacitance therebetween may be used to form the capacitors 26*a* and 26*b* connected between the tip parts 22*a*, 22*b* of the pattern electrodes 16*a*, 16*b* and the input-output electrodes 24*a*, 24*b*.

Also, in each embodiment shown in FIG. 9 through FIG. 14, though the second parts 20*a* and 20*b* of the pattern electrodes 16*a* and 16*b* are respectively extended from the first parts 18*a* and 18*b* at an angle of 45 degrees, it is sufficient to form the second parts 20*a* and 20*b* so as to cross each other, so the second parts 20*a* and 20*b* may be formed at another angle. For example, one angle may be 40 degrees and the other angle may be 50 degrees.

Furthermore, in each embodiment shown in FIG. 9 through FIG. 14, though having two pattern electrodes, that is, two resonators of length λ/4, the present invention can be applied to a high-frequency filter having three or more pattern electrodes, that is, three or more resonators of length λ/4. In this case, the second parts (the open ends) in two adjoining pattern electrodes may be formed so as to cross each other, and a dielectric layer may be formed between the overlapped parts.

Also, in each embodiment shown in FIG. 9 through FIG. 14, though as described each example has a substrate having a high dielectric constant, the present invention is not limited to a high dielectric constant, in view of the miniaturization in the line direction of the pattern electrodes.

Furthermore, in each embodiment shown in FIG. 9 through FIG. 14, though as described each example has resonators of length λ/4 having one end connected to the earth electrode, the present invention is also applicable to a high-frequency filter with each resonator of length λ/2 having one end open.

Also, in each embodiment shown in FIG. 9 through FIG. 14, though one dielectric substrate is used, the present invention is also applicable to a triple plate high-frequency filter wherein plural dielectric layers and so on are laminated and made uniform. In this case, since the coupling between the pattern electrodes becomes strong, the present invention becomes especially useful.

It will be apparent from the foregoing that, 10 while the present invention has been described in detail and illustrated, these are only particular illustrations and examples, and the present invention is not limited to these. The spirit and scope of the present invention is limited only by the appended claims.

We claim:

1. A high-frequency filter comprising:

a dielectric substrate;

an earth electrode formed on one main face of said dielectric substrate; and plural pattern electrodes formed on the other main face of said dielectric substrate so as to be opposite to said earth electrode, wherein first parts of said plural pattern electrodes are formed substantially in parallel and separated by an interval, second parts of said plural pattern electrodes having first and open ends are formed so as to extend away from said first parts at their first ends in non-parallel directions, and a non-magnetic dielectric layer is formed so as to provide a capacitance at an overlap between the second parts of said plural pattern electrodes.

2. A high-frequency filter according to claim 1, wherein a further capacitance is formed between respective open ends of said plural pattern electrodes.

3. A high-frequency filter according to claim 1, wherein each said pattern electrode forms a quarter-wave resonator.

* * * * *